US007234515B2

(12) United States Patent
Auchter et al.

(10) Patent No.: US 7,234,515 B2
(45) Date of Patent: Jun. 26, 2007

(54) HEAT EXCHANGER FOR A MOTOR VEHICLE

(75) Inventors: Holger Auchter, Stuttgart (DE); Thomas Fricker, Remseck (DE); Bruno Lösch, Böblingen (DE)

(73) Assignee: Behr GmbH & Co., Stuttgart (DE)

( * ) Notice: Subject to any disclaimer, the term of this patent is extended or adjusted under 35 U.S.C. 154(b) by 0 days.

(21) Appl. No.: 11/282,973

(22) Filed: Nov. 18, 2005

(65) Prior Publication Data

US 2006/0070729 A1 Apr. 6, 2006

Related U.S. Application Data

(62) Division of application No. 10/264,511, filed on Oct. 4, 2002, now Pat. No. 7,000,690.

(30) Foreign Application Priority Data

Oct. 6, 2001 (DE) ..... 101 49 507

(51) Int. Cl.
*F28D 7/06* (2006.01)
*F28F 9/02* (2006.01)

(52) U.S. Cl. ..... 165/176; 165/175; 165/153

(58) Field of Classification Search ..... 165/176, 165/173, 174, 175, 178, 153; 29/890.038, 29/890.052
See application file for complete search history.

(56) References Cited

U.S. PATENT DOCUMENTS 1,454,107 A * 5/1923 Curran ..... 165/153
3,782,454 A * 1/1974 Slaasted et al. ..... 165/144
3,908,758 A 9/1975 Armonies et al.
4,287,945 A 9/1981 Hessari
4,426,999 A 1/1984 Evans et al.
4,620,590 A 11/1986 Koisuka et al.
4,678,112 A 7/1987 Koisuka et al.
4,945,635 A 8/1990 Nobusue et al.
5,203,407 A 4/1993 Nagasaka
5,314,013 A 5/1994 Tanabe
5,327,959 A * 7/1994 Saperstein et al. ..... 165/173
5,400,853 A * 3/1995 Wolters ..... 165/137
5,524,938 A 6/1996 Halder
5,540,278 A * 7/1996 Chiba et al. ..... 165/175
5,785,119 A 7/1998 Watanabe et al.
5,806,586 A * 9/1998 Osthues et al. ..... 165/174
6,129,146 A 10/2000 Krueger et al.
6,161,616 A 12/2000 Haussmann (Continued)

FOREIGN PATENT DOCUMENTS

DE 35 11 952 A1 10/1986

(Continued)

*Primary Examiner*—Tho Duong
(74) *Attorney, Agent, or Firm*—Leydig, Voit & Mayer, Ltd.

(57) ABSTRACT

A heat exchanger, particularly a flat-tube heat exchanger for a motor vehicle, which includes two coolant boxes and a tube block with an inlet tube attached to one of the boxes and an outlet tube attached to another of the boxes, and wherein each tube extends at least in part along one longitudinal side of the associated box and has at least one radial opening which communicates with a side opening formed in the box.

4 Claims, 2 Drawing Sheets

U.S. PATENT DOCUMENTS

| | | | |
|---|---|---|---|
| 6,257,322 | B1 | 7/2001 | Toh et al. |
| 6,581,679 | B2 | 6/2003 | Fischer et al. |

FOREIGN PATENT DOCUMENTS

| | | | |
|---|---|---|---|
| DE | 689 07 282 | T2 | 6/1993 |
| DE | 44 03 402 | A1 | 8/1995 |
| DE | 197 19 255 | A1 | 11/1998 |
| DE | 199 11 334 | A1 | 9/2000 |
| DE | 199 33 913 | A1 | 2/2001 |
| EP | 0 406 774 | A1 | 1/1991 |
| EP | 1 070 929 | A2 | 1/2001 |
| JP | 404335996 | A | 11/1992 |
| JP | 09061084 | A | 3/1997 |
| JP | 2001050683 | A | 2/2001 |
| WO | WO 98/50748 | | 5/1998 |

* cited by examiner

HEAT EXCHANGER FOR A MOTOR VEHICLE

This patent application is a divisional of U.S. patent application Ser. No. 10/264,511 filed Oct. 4, 2002, now U.S. Pat. No. 7,000,690 and claims the benefit of the filing dates of U.S. patent Ser. No. 10/264,511 and German Patent Application No. DE 101 49 507.2 filed Oct. 6, 2001. The contents of U.S. patent application Ser. No. 10/264,511 and German Patent Application No. DE101 49 507.2 are incorporated in their entirety herein by this reference.

FIELD OF INVENTION

The invention pertains to a heat exchanger, especially a flat-tube heat exchanger for a motor vehicle.

BACKGROUND OF THE INVENTION

German Patent DE 44 03 402 A1 discloses a heat exchanger that features two coolant boxes with a tube block including several parallel tubes that may have a flat configuration. An inlet tube may be attached to one coolant box at one front side via a connector pipe. Accordingly, outlet tubes are attached to the other coolant box by means of suitable connecting pipes. Connecting individual tubes to the associated coolant boxes is particularly expensive.

German Patent DE 197 19 255 A1 describes another heat exchanger, in which one of the coolant boxes contains three chambers, namely an inlet chamber, a reversal chamber and an outlet chamber. Inlet tubes are attached to the fronts of these coolant boxes, and the inlet tube is connected to the inlet chamber, while the outlet tube is connected to the outlet chamber. Such a frontal connection of the tubes to the boxes is relatively complicated.

German Patent DE 35 11 952 C2 describes a heat exchanger with a coolant box made of plastic. This special coolant box contains two inlet chambers, one outlet chamber, and corresponding connector pipes that are integrated into the coolant boxes for attachment of the inlet tubes and of the outlet tube. The outlet chamber of this coolant box has an additional peculiarity, since it is divided into an inlet region and an outlet region, and these regions are connected to each other by means of an overflow opening. The coolant flows from the tube block into the inlet region of the outlet chamber and moves from there through the overflow opening into the outlet region of the outlet chamber. From the outlet chamber the coolant then flows into the outlet tube. Due to the cross sectional design of the overflow opening, a specific flow and thus a specific heat distribution in the tube block can be established.

Thus, a need exists for a heat exchanger of the type described above which can be manufactured at a relatively low cost. The invention provides such a device, which overcomes the disadvantages of other existing heat exchanger designs. These and other advantages of the present invention, as well as additional inventive features will be apparent from the description of the invention provided herein.

BRIEF SUMMARY OF THE INVENTION

The invention includes a heat exchanger with radial openings that connect the inlet and outlet tubes of an associated coolant box. This design simplifies the attachment of the tubes. In addition, the heat exchanger constructed in this manner can be a compact design. Furthermore, there is a possibility of manufacturing the entire heat exchanger from aluminum or aluminum alloys.

A design in which the tubes are soldered to the associated box is particularly favorable. In this manner, the attachment of the individual tubes can be integrated into the soldering of the coolant boxes to the tube block, thus reducing the manufacturing cost of the heat exchanger.

In one embodiment, the radial opening provided on a particular tube, or the side opening provided on the associated coolant box, can have an outward protruding collar ("draw-through") encircling an opening edge; the collar may penetrate into an associated complementary opening and rest against the side of its opening edge. This collar or draw-through simplifies the assembly and ensures a positioning of tube and box so that the implementation of the particular connecting technique, e.g., soldering, will be simplified.

In accordance with a refinement of the invention, the size of the collar or of the draw-through is selected so that, with the collar inserted into the associated opening, a clamping effect is obtained which biases the associated tube against its respective box. Due to this self-mounting, the positioning between tube and box will be made more simple for the particular connecting method. Preferably, the clamping effect can be configured so that the two openings will be relatively tight, at least at low pressures, thereby simplifying the implementation of a dip soldering process, for example.

Other objects and advantages of the invention will become apparent upon reading the following detailed description and upon reference to the accompanying drawings, in which like numerals represent like elements in the several figures.

DETAILED DESCRIPTION OF THE INVENTION

Figure 1:
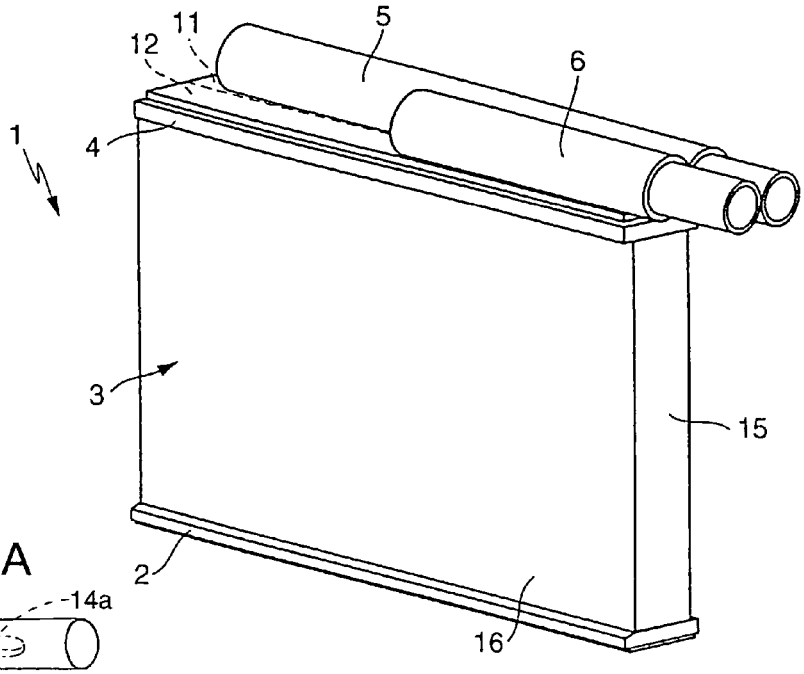
FIG. 1 is a perspective view of a heat exchanger according to an embodiment of the invention.

FIG. 1 illustrates a heat exchanger 1 according to an embodiment of the invention. The heat exchanger 1 includes a first coolant box 2, a tube block 3 and a second coolant box 4. Coolant boxes 2 and 4 will be denoted hereinafter as the lower coolant box 2 and the upper coolant box 4 based on their respective positions in FIG. 1. It should be understood, however, that this nomenclature is selected for purposes of convenience of description. The terms "lower" and "upper" should not be interpreted to limit the invention to a particular orientation.

Lower coolant box 2 is set onto the lower end of the tube block 3, while upper coolant box 4 covers the upper end of tube block 3. Tube block 3, in a conventional manner, consists of a number of tubes, such as flat tubes, which run parallel to each other and usually have a constant mutual spacing. In this embodiment, zig-zag louvers may be installed between the flat sides of the flat tubes, in a sandwich array. The broad side of tube block 3 is usually oriented in a horizontal manner such that an essentially perpendicular air stream flows around and through it.

Furthermore, the heat exchanger 1 has an inlet tube 5 through which coolant enters the heat exchanger, and an outlet tube 6, through which coolant exits the heat exchanger. The tubes 5, 6 extend along one longitudinal side of the upper coolant box 4, and they abut the upper coolant box 4 along this longitudinal side. Although in this embodiment, the outlet tube 6 extends over only about half the length of the upper coolant box 4, it is clear that the outlet tube 6 of another embodiment can also extend over the entire length of the upper coolant box 4.

Figure 2A:
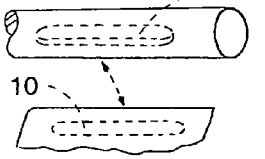
FIG. 2 is a partially exploded view of the embodiment of FIG. 1, rotated 180°.
Figure 2:
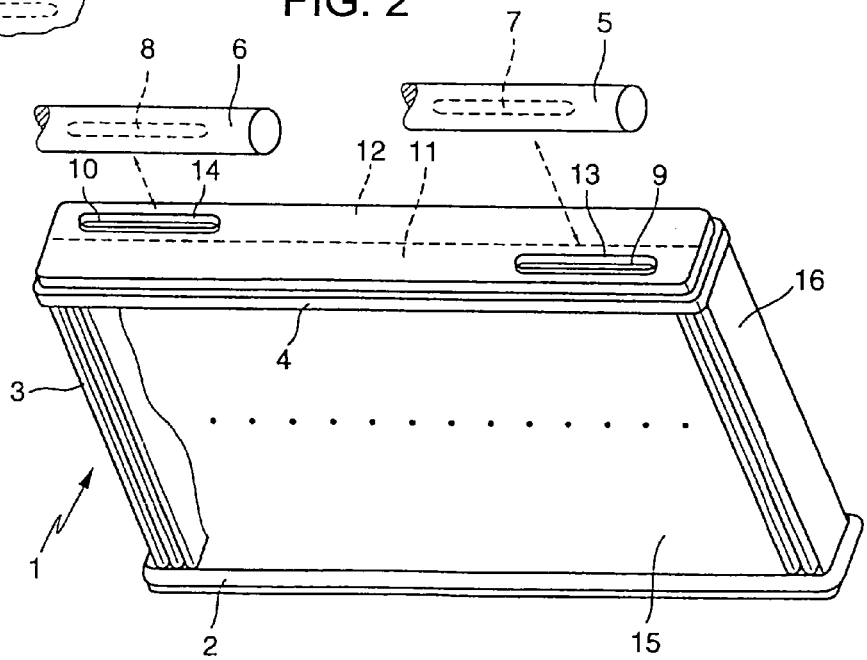

In the embodiment illustrated in FIGS. 1 and 2, the upper coolant box 4 may be configured as a combined inlet and outlet box, which includes in its interior an inlet chamber 11 (not visible here) communicating with the inlet tube 5, and also an outlet chamber 12 (likewise not visible) that communicates with the outlet tube 6. Additionally, in this embodiment, the lower coolant box 2 redirects coolant exiting the tube block 3, back into the tube block 3. Accordingly, the tube block 3 may be a dual-fluted tube block that includes an inlet region 15, through which coolant flows from the inlet chamber 11 of the inlet and outlet box 4 to the reversal box 2, and of a return region 16, through which coolant flows from the reversal box 2 to the outlet chamber 12 of the inlet and outlet box 4. In the embodiment according to FIGS. 1 and 2, this organization into inlet and outlet regions 15, 16 is set up transversely to the longitudinal direction of the boxes 2, 4, so that this description is of a reversal "at depth." Other variations are described in the descriptions relating to FIGS. 4 and 5.

As illustrated in FIG. 1, the mounted tubes 5 and 6 may be in contact, and in accordance with another embodiment of the invention, they can also be connected to each other, for example, by a soldered joint.

In FIG. 1, the broken line symbolically illustrates the division of the upper coolant box 4 into the outlet chamber 12 in the foreground, and the inlet chamber 11 in the background. In FIG. 2, the representation is correspondingly rotated approximately 180°, such that inlet chamber 11 is in the foreground.

According to FIG. 2, each of the tubes 5, 6 contains one radial opening 7, 8, respectively. Accordingly, for each radial opening 7, 8, the upper coolant box 4 features a corresponding side opening 9, 10. With the tubes 5, 6 mounted, the radial openings 7, 8 of the tubes 5, 6 are tightly joined to the respective side openings 9, 10 of the upper coolant box 4, so that the inlet tube 5 communicates with the inlet chamber 11 and the outlet tube 6 with the outlet chamber 12. To provide a better view, the tubes 5, 6 of FIG. 2 are shown disconnected from the upper coolant box 4.

In this embodiment, each side opening 9, 10 of the upper coolant box 4 may be equipped with an outwardly protruding collar 13, 14, which encloses the particular opening edge. When the tube 5, 6 is attached, the collar 13, 14 penetrates into the associated, complementary radial opening 7 or 8 and accordingly abuts the edge of the opening. The dimensions are selected so that when the radial opening 7, 8 receives the respective collar 13, 14, a press-fit effect results, which holds, or rather, secures the particular tube 5 or 6 to the upper coolant box 4 for easier assembly. The press-fit simplifies placement of a solder joint between the tubes 5, 6 and the coolant box 4. As a result, the tubes 5, 6, together with the boxes 2, 4 and the individual parts of the tube block 3 can be soldered to each other in one common soldering process.

In one embodiment, tubes 5, 6 are installed on the opposite side of the upper coolant box 4 from the tube block 3, so that the entire heat exchanger 1 can have a relatively small depth. In another embodiment, at least one of the tubes 5, 6 can be attached to the front side or to the rear side of the particular coolant box 2, 4, respectively. Due to the design according to this invention, a particularly small design height will result for the individual coolant boxes 2, 4, so that the entire heat exchanger 1 will be a relatively compact structure.

In the embodiment according to FIGS. 1 and 2, radial openings 7, 8, and also associated side openings 9, 10 are essentially congruent to each other. Furthermore, these openings 7, 8, 9, 10 are designed as longitudinal slits which extend in the longitudinal direction of the tubes 5, 6 and the upper coolant box 4, respectively.

Figure 3:
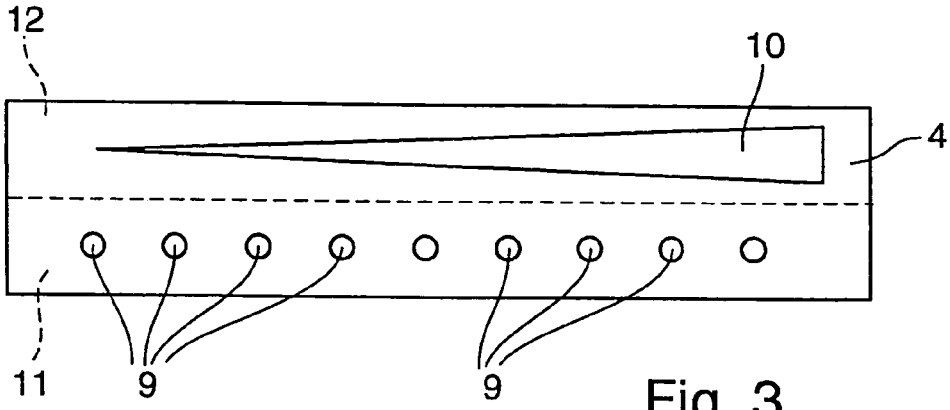
FIG. 3 is a longitudinal cross section of another embodiment of the invention, particularly illustrating the cooling box.

Although the openings 7, 8, 9, 10 in the embodiment according to FIG. 2 have an essentially constant opening width along their longitudinal extension, FIG. 3 illustrates an embodiment wherein at least one of the openings (here: the outlet side opening 10) may have a variable opening width along its longitudinal extension. Likewise, it may be possible to join a respective tube 6, 5 to a coolant box 2, 4 by means of several radial openings 7, 8. Accordingly, FIG. 3 illustrates an embodiment with a number of parallel side openings 9 on the inlet side. Due to the location and dimensions, and also due to the geometry of the openings 7, 8, 9, 10, any desired flow, and thus, any particular heat distribution within the tube block 3 can be adjusted, so that the heat exchanger 1 of the present invention may be adjusted to various installation conditions.

Figure 4:
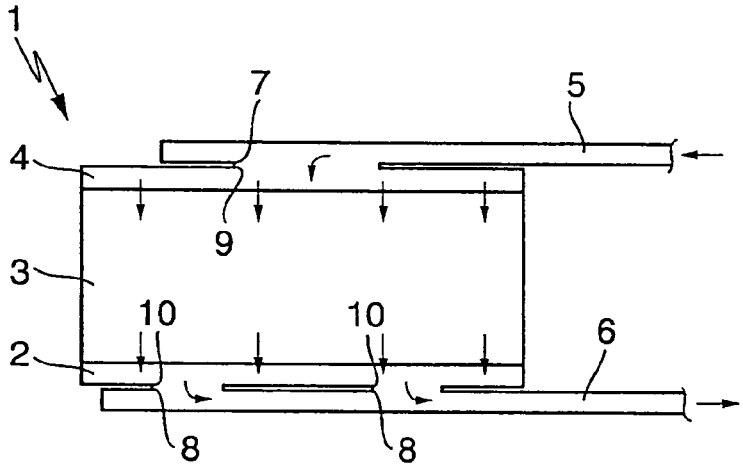
FIG. 4 is a schematic view of still another embodiment of the present invention.

According to the embodiment of FIG. 4, in another design embodiment, a first coolant box, e.g., the upper coolant box 4, is designed as the inlet box to which the inlet tube 5 is attached. In contrast to this, the other coolant box, e.g., the lower coolant box 2, is designed as the outlet box to which the outlet tube 6 is attached. In this design embodiment, the tube block 3 is designed as single duct.

Figure 5:
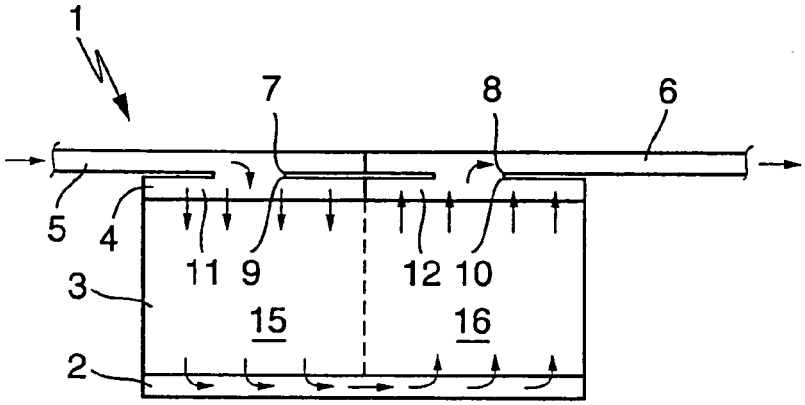
FIG. 5 is a schematic view of a further embodiment of the present invention.

In another embodiment, illustrated in FIG. 5, the one coolant box, e.g., the upper coolant box 4, is designed, as in the embodiment according to FIGS. 1 and 2, as an inlet and outlet box, to which both the inlet tube 5 and also the outlet tube 6 are attached. The other box, e.g., the lower coolant box 2, is then designed as a reversal box, which redirects the coolant exiting from the tube block 3 back into the tube block 3. Accordingly, the inlet and outlet boxes 2, 4 of this embodiment also contains the inlet chamber 11 and the outlet chamber 12, which abut along the longitudinal direction of the box. In contrast to the design embodiment according to FIGS. 1 and 2, the tube block 3 here is divided in the longitudinal direction of boxes 2 and 4 into an inlet region 15 and a return region 16. Accordingly, the coolant flows from the inlet tube 5 into the inlet chamber 11, through the inlet region 15 into the reversal box 2, from there into the return region 16, then into the outlet chamber 12 and exits from the heat exchanger 1 via the outlet tube 6.

According to this invention, heat exchanger 1 may be built in an exceptionally compact design, where the connection of tubes 5 and 6 can be integrated into the soldering process for a tight joint of the individual components. As a result, a heat exchanger 1 can be manufactured entirely of aluminum or of aluminum alloys. Due to the versatile shapes of the openings 7, 8, 9, 10, the heat exchanger 1 manufactured in this manner can also be adapted very easily to differing installation situations.

While this invention has been described with an emphasis upon preferred embodiments, variations of the preferred embodiments may be used, and it is intended that the invention can be practiced otherwise than as specifically described herein. Accordingly, this invention includes all modifications encompassed within the spirit and scope of the invention as described by the following claims.

What is claimed is:

1. A heat exchanger for a motor vehicle comprising:

a first coolant box that includes an inlet chamber with at least one side opening and an outlet chamber with at least one side opening;

a second coolant box;

a tube block disposed between the first and second coolant boxes and attached to both coolant boxes;

an inlet tube attached to at least part of a longitudinal side of the first coolant box, the inlet tube further including at least one radial opening that is joined in fluid communication with a side opening of the inlet chamber;

an outlet tube attached to at least part of a longitudinal side of the first coolant box, the outlet tube further including at least one radial opening that is joined in fluid communication with a side opening of the outlet chamber; and wherein the at least one radial opening of the inlet tube and/or the outlet tube comprises a slit of a predetermined varying width that extends in the longitudinal direction of the inlet tube and/or the outlet tube.

2. The heat exchanger of claim 1 wherein the at least one radial opening of the inlet tube and the outlet tube comprises a slit of a predetermined varying width that extends in the longitudinal direction of the inlet tube and the outlet tube.

3. The heat exchanger of claim 1 wherein the inlet and outlet tubes are attached to the same longitudinal attachment side of the first coolant box.

4. The heat exchanger of claim 3 wherein the inlet and outlet tubes abut one another and are joined together.

* * * * *